US005771013A

United States Patent [19]

Fey

[11] Patent Number: 5,771,013

[45] Date of Patent: Jun. 23, 1998

[54] METHOD FOR STABILIZING COMPOSITIONS CONTAINING CARBONYL IRON POWDER

[75] Inventor: Kenneth Christopher Fey, Midland, Mich.

[73] Assignee: Dow Corning Corporation, Midland, Mich.

[21] Appl. No.: 360,949

[22] Filed: May 1, 1989

[51] Int. Cl.[6] ..... H01Q 17/00; H01F 1/26

[52] U.S. Cl. ..... 342/4; 252/62.54; 252/62.55

[58] Field of Search ..... 252/62.54, 62.55; 342/1, 4

[56] References Cited

U.S. PATENT DOCUMENTS 4,582,754 4/1986 Ryoke et al. ..... 252/62.54

4,731,191 3/1988 Swihart ..... 252/62.54

4,985,166 1/1991 Leising et al. ..... 252/62.54

FOREIGN PATENT DOCUMENTS 319828 6/1989 European Pat. Off. ..... 252/62.54

*Primary Examiner*—Peter A. Nelson

*Attorney, Agent, or Firm*—Larry A. Milco

[57] ABSTRACT

A mixture of carbonyl iron powder and a silicone resin containing silica siloxane units and silanol groups can be stabilized for storage by mixing a stabilizing amount of an halosilane with the mixture; monochlorosilanes are preferred. The small amount of halosilane that is needed can be further reduced by vacuuming the mixture before adding the halosilane. The stabilized compositions are useful as reactive components in curable silicone mixtures.

16 Claims, No Drawings

METHOD FOR STABILIZING COMPOSITIONS CONTAINING CARBONYL IRON POWDER

BACKGROUND OF THE INVENTION

The Government has rights in this invention pursuant to Contract No. F33615-83-C-5084 awarded by the Department of the Air Force.

The present invention relates to improved silicone compositions containing carbonyl iron powder, herein also referred to as CIP for convenience. More specifically, this invention relates to CIP-containing silicone compositions which have improved storage stability.

CIP is used as a component in the formation of cores in electronic devices such as tuned circuits, chokes and transformers. Typically, CIP is processed so that its individual particles are insulated and then intimately mixed with a binder and the magnetic core is thereafter molded from the mixture, using conventional molding methods. The resulting cores can be lightly machined and turned if necessary. Examples of suitable insulating materials include lacquers, shellacs, waterglass and phosphoric acid. Examples of suitable binders include thermosetting resins and thermoplastic resins. The volume fraction of iron in the core can be as high as 95%.

When untreated CIP, which is basic, is mixed with a composition that contains a silicone resin comprising $SiO_{4/2}$ siloxane units and silanol groups an upward drift in the viscosity of the mixture occurs, eventually leading to the gellation of the mixture. Although this reaction is of little consequence if the mixture is used promptly, it is a serious matter if the mixture is to be stored for a period of time before being used. A further concern is the generation of hydrogen in silicone mixture which contain silicon hydride groups, silanol groups and basic CIP.

Swihart, U.S. Pat. No. 4,731,191 discloses a method for preparing a composition containing CIP and a silicone binder comprising heating and mixing CIP with a silicon compound which contains one or more reactive silicon-bonded radicals in an amount sufficient to reduce the atmospheric oxidation of the CIP and then mixing the resulting CIP with the binder. The reactive silicon-bonded radicals include hydrogen, hydroxyl, alkoxy such as methoxy and ethoxy, and other radicals which provide neutral compounds when removed from silicon by hydrolysis.

My copending application for U.S. patent Ser. No. 815,436, filed on Dec. 31, 1985 and assigned to the assignee of this invention, discloses a method for preparing a composition containing CIP and a silicone resin comprising $SiO_{4/2}$ siloxane units, SiH sites and SiOH sites comprising ventilating basic CIP sufficiently to reduce its pH to a value of less than 7.5 and mixing the resulting CIP with a composition comprising the silicone resin.

Although these methods produce stable silicone compositions comprising CIP they suffer from the drawback that the CIP must be processed in a separate step before it is mixed with the silicone; thereby increasing the complexity, cost and, in view of the combustible nature of CIP dust, the hazard of the processes.

BRIEF SUMMARY OF THE INVENTION

It is an object of this invention to provide CIP-filled silicone compositions having improved stability. It is another object of this invention to provide an improved method for preparing CIP-containing silicone composition.

These objects, and others which will become apparent upon consideration of the following disclosure and appended claims, are obtained by the present invention which comprises mixing CIP with a silicone composition which contains a silicone resin comprising silica siloxane units, i.e., $SiO_{4/2}$ units and silanol groups, and treating the mixture with an halosilane. If desired, the method of this invention can further comprise subjecting the mixture of CIP and silicone resin to a vacuum, with or without heating, before mixing the halosilane therewith. The resulting compositions have improved stability toward severe viscosity increase during storage; some can be stored for 30 days without experiencing any viscosity increase.

DETAILED DESCRIPTION OF THE INVENTION

The present invention relates to a method for improving the stability of a mixture comprising carbonyl iron powder and a silicone resin containing $SiO_{4/2}$ siloxane units and SiOH sites, said method comprising mixing a viscosity-stabilizing amount of an halosilane with said mixture.

Commercial CIP, available in various sieve sizes, hardnesses and purities, and typically having a pH of 8 or more, can be used in the method of this invention. The reduced-pH CIPs of my above-noted copending patent application can also be used in the method of this invention.

For the purposes of this invention the pH of a CIP is determined by slurrying 4 grams of the CIP with 100 ml. of deionized water which has been adjusted to a pH of 7.0 with nitric acid. After 5 minutes of slurrying the pH of the aqueous phase is measured, using a pH meter.

Although not limiting this invention by any theory I believe that the basic nature of untreated CIP is due to the presence of ammonia and organic amines which arise from the particular process that is used to prepare the CIP. In that process purified iron pentacarbonyl is thermally decomposed in the vapor state to deposit iron particles in the form of discrete spheres ranging in size from 1 to 10 micrometers in diameter and containing small amounts of carbon and nitrogen. The resulting basic CIP typically has an ammonia component which can be detected by sampling the gas phase above basic CIP that has been stored in a closed container.

The silicone resin that is used in the method of this invention can be any polysiloxane which contains $SiO_{4/2}$ siloxane units and silicon-bonded hydroxyl radicals, i.e., silanol groups. There may also be present in the silicone resin other siloxane units having the formula $R'_aSiO_{(4-a)/2}$ wherein a has a value of 1, 2 or 3 and R' denotes a radical selected from the group consisting of hydrogen, alkoxy radicals having from 1 to 6 carbon atoms, and hydrocarbyl radicals having from 1 to 8 carbon atoms, such as alkyl, alkenyl, cycloalkyl, cycloalkenyl, aryl, aralkyl and alkaryl. Typically R' is methyl, phenyl and/or vinyl, when present.

While not limiting this invention by any theory, I believe that an organopolysiloxane which bears an average of more than two silanol sites per molecule undergoes a silanol condensation reaction in the presence of basic CIP which leads eventually to a gel structure, the extent of which varies directly with the silanol content of the organopolysiloxane. While this gelling reaction may have utility it is an undesirable reaction in a composition that has to be stored and then used at some later date.

In the case of a silicone resin further containing $SiO_{4/2}$ siloxane units a more rapid formation of a gelled structure results. When the silanol content of a siloxane resin containing $SiO_{4/2}$ siloxane units exceeds about 0.5% by weight this gelling reaction becomes unacceptable for a composition that is to be stored for a month or more.

Silicone resins containing $SiO_{4/2}$ siloxane units and silanol groups are well known in the silicone art. For examples, the disclosures of U.S. Pat. Nos. 2,676,182; 2,814,601; 2,857,356; 3,389,114; and 4,539,232 are incorporated herein to teach how to prepare silicone resins comprising $SiO_{4/2}$ siloxane units and silanol groups.

The preferred silicone resin that is used in the method of this invention is a doubly reactive resin comprising $SiO_{4/2}$ siloxane units, sites wherein a hydrogen atom is bonded directly to silicon atom, possibly for eventual reaction with silanol radicals and/or aliphatically unsaturated materials, and sites wherein a hydroxyl radical is directly bonded to a silicon atom, possibly for eventual reaction with silicon hydride atoms and/or other silanol radicals, if desired.

Doubly reactive silicone resins containing $SiO_{4/2}$ siloxane units, SiH sites and SiOH sites are well known in the silicone art. For examples, the disclosures of U.S. Pat. Nos. 3,627,851, 4,310,678 and 4,774,310 are incorporated herein to teach how to prepare silicone resins comprising $SiO_{4/2}$ siloxane units, SiH sites and SiOH sites.

The method and compositions of this invention comprise any silicone resin containing $SiO_{4/2}$ units and silanol groups; however, the doubly reactive silicone resin compositions disclosed by Blizzard and Swihart in U.S. Pat. No. 4,310,678 have been shown to be particularly benefitted by the present invention.

Briefly, the silicone resin compositions of Blizzard and Swihart are prepared by forming a homogeneous mixture having an acid number greater than zero and comprising (a) an organic solvent solution of a resinous copolymeric siloxane containing silicon-bonded hydroxyl radicals and consisting essentially of $R_3SiO_{1/2}$ siloxane units and $SiO_{4/2}$ siloxane units wherein the ratio of the former to the latter, on a molar basis, has a value of from 0.6/1 to 0.9/1 and each R denotes a monovalent hydrocarbon radical; and (b) an organohydrogenpolysiloxane wherein each organic radical is a monovalent hydrocarbon radical, there being an average of at least one silicon-bonded hydrogen atom per molecule of said organohydrogenpolysiloxane; and heating the homogeneous mixture to remove substantially all of the organic solvent therefrom. While the R radicals, and other organic radicals that are present in the siloxane reactants, can be any monovalent hydrocarbon radical, such as methyl, vinyl and phenyl, the doubly reactive silicone resin is preferably prepared from methyl-containing resinous copolymeric siloxanes and methylhydrogenpolysiloxanes.

In particular, a doubly reactive silicone resin composition that has been prepared by (A) forming a homogeneous mixture having an acid number greater than zero and comprising (a) an organic solvent solution of from 40 to 60, preferably 50, parts by weight of a resinous copolymeric siloxane containing silicon-bonded hydroxyl radicals and consisting essentially of $(CH_3)_3SiO_{1/2}$ siloxane units and $SiO_{4/2}$ siloxane units wherein the ratio of the former to the latter, on a molar basis, has a value of from 0.6/1 to 0.9/1, and (b) 40 to 60, preferably 50, parts by weight of a methylhydrogenpolysiloxane having the formula $Me_3SiO(Me_2SiO)_xSiMe_3$ wherein Me denotes the methyl radical and x has a value of from 35 to 70; and (B) heating the homogeneous mixture to remove substantially all of the organic solvent therefrom is a particularly useful silicone resin from the aspect of convenient mixing viscosity and reactivity with other organopolysiloxane compositions.

In the method of this invention the CIP is mixed with the silicone resin, most preferably at room temperature, using any mixing means that are commonly used in the organosiloxane polymer art, such as impeller mixers, sigma blade mixers and two or three roll mills. Additionally, it is preferred that the CIP be admixed into the silicone resin rather than the reverse, although this is not necessary. Solvents, such as toluene, xylene or hexane, can be used to facilitate this mixing, if desired.

The CIP and the silicone resin can be mixed in any desired weight ratio; however, the compositions that are typically benefitted by this invention are rich in CIP and have a ratio of the former to the latter of from 1/1 to 20/1, on a weight basis.

In the method of this invention an halosilane is mixed with the mixture of CIP and silicone resin. It is not clear at this time whether the halosilane reacts with the CIP, with the alkaline component of the CIP, with the silicone resin or in some other manner that results in the stability increase that has been observed for the compositions prepared by the method of this invention.

Although not required in the method of this invention vacuuming, i.e., devolatilizing at reduced pressure, the mixture comprising basic CIP and the silicone resin is a preferred step because it provides greater stability than the use of a given amount of an halosilane alone. It is believed that vacuuming can be done at any reduced pressure; however, it is generally recommended to use as low a pressure (as high a vacuum) as is readily attainable.

Vacuuming can be accompanied by the application of heat to the mixture of basic CIP and silicone resin in order to accelerate and/or complete the removal of volatile material from the mixture. While a temperature of up to 100° C. has been found to be a suitable temperature, greater temperatures can also be used. An inert atmosphere, such as nitrogen, is recommended when heating CIP.

The halosilane compound has one or more silicon-bonded halogen atoms, such as fluorine, chlorine, bromine or iodine. Two or more types of these halogen atoms can also be present in the halosilane compound. Chlorosilanes are preferred because they are generally more reactive than fluorosilanes and they are easier to handle than the other halosilanes.

Examples of silanes which are suitable for use in the method of this invention include chlorosilanes having from one to four, but preferably one, chlorine atoms per silicon, any other radicals in the silane being selected from the group consisting of hydrogen, alkoxy, such as methoxy and ethoxy; and hydrocarbon radicals, such as alkyl, alkenyl, aryl, aralkyl, alkaryl and cycloaliphatic.

Specific examples of suitable chlorosilanes include monochlorosilanes, such as trimethylchlorosilane, dimethylchlorosilane, phenyldimethylchlorosilane, vinyldimethylchlorosilane, methyldimethoxychlorosilane, dimethoxychlorosilane and dimethylmethoxychlorosilane; dichlorosilanes, such as dimethyldichlorosilane, phenylmethyldichlorosilane, methyldichlorosilane and dimethoxydichlorosilane; trichlorosilanes, such as methyltrichlorosilane and vinyltrichlorosilane; and tetrachlorosilane.

Examples of silanes which are preferred for use in the method of this invention include chlorosilanes having the formula $R_3SiCl$ wherein R denotes a monovalent hydrocarbon radical having from one to six, preferably one to two, carbon atoms, such as alkyl, alkenyl, aryl, and cycloaliphatic. Vinyldimethylchlorosilane is a highly preferred chlorosilane for the method of this invention because it is thought to provide reactive sites for silicon-bonded hydrogen atoms.

In general, for the preferred compositions of this invention, the halosilane should be mixed with the mixture of basic CIP and silicone resin promptly, such as immediately or within a few hours, after the mixture has been prepared, irrespective of any prior vacuuming, in order to realize the full benefit of the method of this invention.

The amount of halosilane that is effective in the method of this invention is merely that amount that will provide improved stability for the mixture of CIP and silicone resin. Generally, the amount of halosilane to be used should not be more than that needed to provide the desired stabilizing effect in order to limit the amount of free halosilane in the stabilized composition of this invention.

One means of measuring the improvement of a mixture of CIP and silicone resin is the length of time that transpires before the viscosity of the mixture increases by a factor of two. Still another means of measuring the improvement of a mixture is the length of time before the viscosity increases to an undesirable but acceptable value of 20,000 centipoise, at ambient temperature. These periods of time are desirably at least as long as the desired work time of the mixture, and are preferably as long as an 8 hour work shift, and are most preferably as long as a 30 day shipping and storage time.

An effective amount of halosilane appears to be related to the amount of vacuuming to which the mixture of basic CIP and silicone resin has been subjected. It is therefore thought to be related also to the amount of basic CIP that is present in the mixture to be stabilized.

Generally the amount of halosilane can be limited to less than about 1.0, preferably less than about 0.5, and most preferably from 0.1 to 0.4, milliequivalents of halogen, per 100 parts by weight, based on the weight of basic CIP in the mixture. For a monohalosilane, such as the preferred vinyldimethylchlorosilane, these amounts are also equal to millimols of halosilane per 100 parts by weight of CIP. Of course, the millimols or milliequivalents of halosilane and the parts by weight of CIP are to be taken on the same mass basis. For example, grams of CIP require milligram-equivalents and milligram-mols; and pounds of CIP require millipound-equivalents and millipound-mols of halosilane.

The halosilane is preferably added to the mixture of CIP and silicone resin as a solution, using one or more non-reactive solvents, such as hydrocarbons and halogenated hydrocarbons.

Using these general guidelines, the examples disclosed below and a few experiments, one can determine a suitable molar amount of any halosilane, not specifically disclosed, to mix with any specific mixture comprising basic CIP and a silicone resin. However, vacuuming alone does not seem to be sufficient to adequately stabilize a mixture of basic CIP and silicone resin.

The compositions of this invention are useful as a reactive component in curable silicone binder compositions. These curable silicone compositions typically comprise a polydiorganosiloxane bearing curing radicals, such as hydroxyl, alkoxy, vinyl and the like.

Said binder compositions further comprise a curing agent to improve and/or accelerate the curing reaction of the polydiorganosiloxane. Examples of typical curing agents include catalyst, such as peroxide compounds, tin compounds and platinum compounds; crosslinking agents, such as silanes and siloxanes bearing silicon-bonded hydrogen atoms or alkoxy radicals; and mixtures of catalysts and crosslinking agents.

The silicone binder can further comprise typical cure control additives that are well known in the silicone art for controlling the metal-catalyzed curing reaction of silicon-bonded hydrogen atoms. Examples of said cure control additives include, but are not limited to, acetylenic compounds, maleate esters, olefinically substituted siloxanes and the like.

The silicone binder can further comprise optional components such as fillers, volatile and non-volatile diluents such as hydrocarbon solvents, low molecular weight siloxanes and high molecular weight siloxanes, vinyl- and/or silanol-functional polydiorganosiloxanes and reactivity modifiers.

Among many such silicone compositions are those disclosed in U.S. Pat. Nos. 4,322,518 and 4,537,829 and in Blizzard's application titled "Curable Silicone Compositions Comprising SiH-Containing Resin and Anti-Hydrogen Additive", Ser. No. 815,437, filed on Dec. 31, 1985 and assigned to the assignee of this invention. The disclosures of Blizzard's application and the disclosures of U.S. Pat. Nos. 4,322,518 and 4,537,829 are incorporated herein by reference to teach some preferred silicone binders of the art.

The following examples are disclosed to further illustrate, but not limit, the present invention which is properly delineated by the appended claims.

Parts and percentages are by weight, unless otherwise stated. Viscosity was measured at 25° C. using a Brookfield rotating spindle viscometer.

The siloxanes referred to in the examples are:

SILOXANE A

A silicone resin prepared according to the method of U.S. Pat. No. 4,310,678 wherein the ratio of resinous copolymeric siloxane to organohydrogenpolysiloxane that were used to prepare the silicone resin had a value of 1.0/1.0. The resinous copolymeric siloxane consisted of $(CH_3)_3SiO_{1/2}$ siloxane units and $SiO_{4/2}$ siloxane units in a mol ratio of about 0.7/1.0. The organohydrogenpolysiloxane had the formula $Me_3SiO(Me_2SiO)_{35}SiMe_3$ wherein Me denotes the methyl radical.

SILOXANE B

A mixture of 100 parts of a vinyl-terminated polydimethylsiloxane having a viscosity of approximately 35,000 centipoise and 750 dimethylsiloxy units per molecule and 40 parts of a silicone resin composed of $Me_2ViSiO_{1/2}$ units, $Me_3SiO_{1/2}$ units and $SiO_{4/2}$ units in the ratio 0.15:0.6:1.

EXAMPLES 1–9

A composition was prepared by thoroughly mixing 1,596 grams of basic CIP (Grade E from United Mineral and Chemical Corp., New York, N.Y., having a nominal purity of 98% and a pH of 8.3) and 400 grams of Siloxane A.

A 500 gram portion of the mixture was mixed with 2.5 grams of methylvinylcyclosiloxanes and 0.5 grams of methylbutynol as platinum catalyst cure-control additives and was labeled as Batch 1. The balance of the mixture was placed in a vessel and was vacuumed at a vacuum of 28" of mercury and a temperature of 32° C. for 2.5 hours. A nitrogen bleed was used to purge the vacuum chamber. A 500 gram portion of the vacuumed mixture was mixed with 2.5 grams of methylvinylcyclosiloxanes and 0.5 grams of methylbutynol and was labeled as Batch 2. The material remaining in the vessel was then vacuumed at a vacuum of 28" of mercury and at a temperature of 99° C. for 1 hour. A nitrogen bleed was used to purge the vacuum chamber. A 500 gram portion of the vacuumed and heated mixture was mixed with 0.5 grams of methylbutynol and 2.5 grams of methylvinylcyclosiloxanes and was labeled as Batch 3.

Three 100-gram portions of each of Batches 1, 2 and 3 were separated and were treated with either 0.22, 0.44 or 0.66 grams of a 5% solution of dimethylvinylchlorosilane in xylene and were labeled as Samples B, C and D, respectively. The balance of each Batch, labeled as Sample A, received no further treatment and thus represent controls.

A comparison composition was prepared by mixing 159.6 grams of CIP which had been heated and ventilated at 125° C. for several hours in a nitrogen atmosphere to reduce its pH to a value of less than 7.5, 39.8 grams of Siloxane A, 1.0 gram of methylvinylcyclosiloxane and 0.2 grams of methylbutynol.

The viscosity at room temperature of each material was observed over a period of 36 days, or until the sample gelled, if sooner. The results, summarized in Table I, show that the storage stability of a mixture of CIP and a siloxane resin is directly related to the amount of dimethylvinylchlorosilane that was used to treat the mixture and to the amount of vacuuming to which the mixture was subjected. Batch-Samples 1-A, 2-A and 3-A are not examples of the method of this invention because they received no chlorosilane treatment. Mixtures receiving 0.44 or 0.66 grams of vinyldimethylchlorosilane solution per 100 grams of the mixture (equal to 0.23 and 0.34 milligram-mols of chlorosilane per 100 grams of CIP), i.e., Examples 4–9, experience no substantial viscosity increase over a period of 36 days. Mixtures receiving 0.22 grams of vinyldimethylchlorosilane solution per 100 grams of the mixture (equal to 0.11 milligram-mols of chlorosilane per 100 grams of CIP), i.e., Examples 1–3, experience a viscosity increase over a period of 36 days, the extent of which was inversely proportional to the amount of vacuuming the mixture had received before being treated with halosilane.

One part of the 36-day old mixtures of Examples 6, 7 and 8 and the comparison mixture were each mixed with 2.5 parts of a silicone binder composition consisting of 79.94% basic CIP, 19.92% Siloxane B and 0.14% of a platinum-containing catalyst; The four resulting curable compositions were heated at 150° C. A cured composition was obtained in each case.

TABLE I

| | | Viscosity, cps. After | | | | |
|---|---|---|---|---|---|---|
| Ex. | Batch/Sample | 1 day | 4 days | 9 days | 22 days | 36 days |
| * | 1/A | 21375 | 70600 | GEL | — | — |
| * | 2/A | 18850 | 53700 | GEL | — | — |
| * | 3/A | 16250 | 19725 | 37750 | GEL | — |
| * | Comparison | 10975 | 9200 | 10300 | 12100 | 13900 |
| 1 | 1/B | 8250 | 7225 | 12750 | 24250 | $>10^6$ |
| 2 | 2/B | 8200 | 7250 | 7950 | 14775 | 59800 |
| 3 | 3/B | 8850 | 8700 | 8550 | 7900 | 13500 |
| 4 | 1/C | 5250 | 3850 | 4025 | 5475 | 9875 |
| 5 | 2/C | 5450 | 5100 | 4250 | 4025 | 5500 |
| 6 | 3/C | 6225 | 5225 | 4650 | 5100 | 5200 |
| 7 | 1/D | 4200 | 3850 | 3600 | 3975 | 10950 |
| 8 | 2/D | 4000 | 4325 | 3525 | 3750 | 4000 |
| 9 | 3/D | 4325 | 3800 | 4200 | 3900 | 3975 |

* = Not a composition of this invention.

EXAMPLES 10–12

A mixture was prepared by thoroughly mixing 798 grams of the basic CIP described above, 199 grams of Siloxane A, 4.8 grams of methylvinylcyclosiloxanes and 1.0 gram of methylbutynol.

Each of six 100-gram portions of the mixture were mixed with one of the following solutions and the viscosities of the resulting mixtures were measured over a period of 26 days. The resulting data are summarized in Table II.

Solution A—10% trimethylchlorosilane in xylene.
Solution B—4.8% dimethylvinylchlorosilane in xylene.
Solution C—4.9% Octanoic acid in xylene.
Solution D—1.0% Acetic acid in xylene.

TABLE II

| | Solution | | Viscosity, cps. After | | | | |
|---|---|---|---|---|---|---|---|
| Ex. | Identity | Amount | 0 day | 7 days | 13 days | 21 days | 26 days |
| 10 | A | 0.10 g | 5520 | 10300 | 24250 | 70000 | >500000 |
| 11 | A | 0.05 g | 7350 | 32750 | GEL | — | — |
| 12 | B | 0.22 g | 5850 | 10100 | 19425 | 60400 | >500000 |
| * | C | 0.25 g | 6100 | GEL | GEL | — | — |
| * | C | 0.49 g | 4650 | GEL | GEL | — | — |
| * | D | 0.25 g | 6000 | 22800 | GEL | — | — |
| * | None | — | 8300 | 260000 | GEL | — | — |

* = Not a composition of this invention.

That which is claimed is:

1. A method for improving the stability of a mixture comprising carbonyl iron powder and a silicone resin containing $SiO_{4/2}$ siloxane units and SiOH sites, said method comprising mixing a viscosity-stabilizing amount of an halosilane with said mixture.

2. A method according to claim 1 wherein the silicone resin is a liquid silicone resin containing $SiO_{4/2}$ siloxane units, SiH sites and SiOH sites which has been prepared by (A) forming an acidic homogeneous mixture comprising (a) an organic solvent solution of from 40 to 60 parts by weight of a resinous copolymeric siloxane containing silicon-bonded hydroxyl radicals and consisting essentially of $(CH_3)_3SiO_{1/2}$ siloxane units and $SiO_{4/2}$ siloxane units wherein the ratio of the former to the latter, on a molar basis, has a value of from 0.6/1 to 0.9/1, and (b) 40 to 60 parts by weight of a methylhydrogenpolysiloxane having the formula $Me_3SiO(Me_2SiO)_xSiMe_3$ wherein Me denotes the methyl radical and x has a value of from 35 to 70; and (B) heating the homogenous mixture to remove substantially all of the organic solvent therefrom; and the halosilane is a chlorosilane.

3. A method according to claim 2 wherein the chlorosilane has the formula $R_3SiCl$, wherein R denotes a monovalent hydrocarbon radical having 1 to 6 carbon atoms, which is mixed in an amount equal to from about 0.1 to 0.4 millimols per 100 parts by weight of the basic carbonyl iron powder.

4. A method according to claim 3 wherein the chlorosilane is vinyldimethylchlorosilane.

5. A method according to claim 3 wherein the mixture is vacuumed at a temperature of up to 100° C. before the chlorosilane is mixed therewith.

6. A method according to claim 5 wherein the chlorosilane is vinyldimethylchlorosilane.

7. A method according to claim 3 wherein the mixture is vacuumed at ambient temperature before the chlorosilane is mixed therewith.

8. A method according to claim 7 wherein the chlorosilane is vinyldimethylchlorosilane.

9. The composition produced by the method of claim 1.

10. The composition produced by the method of claim 2.

11. The composition produced by the method of claim 3.

12. The composition produced by the method of claim 4.

13. The composition produced by the method of claim 5.

14. The composition produced by the method of claim 6.

15. The composition produced by the method of claim 7.

16. The composition produced by the method of claim 8.

* * * * *